US006341989B1

(12) United States Patent
Jaag

(10) Patent No.: US 6,341,989 B1
(45) Date of Patent: Jan. 29, 2002

(54) CONNECTING TERMINAL ASSEMBLY

(75) Inventor: Dieter Jaag, Villingen-Schwenningen (DE)

(73) Assignee: RIA-BTR Produktions GmbH (DE)

( * ) Notice: Subject to any disclaimer, the term of this patent is extended or adjusted under 35 U.S.C. 154(b) by 0 days.

(21) Appl. No.: 09/567,167

(22) Filed: May 8, 2000

Related U.S. Application Data

(63) Continuation of application No. 09/151,010, filed on Sep. 10, 1998, now Pat. No. 6,270,384.

(30) Foreign Application Priority Data

May 27, 1998 (DE) ..... 198 23 648

(51) Int. Cl.[7] ..... H01R 4/28

(52) U.S. Cl. ..... 439/725

(58) Field of Search ..... 439/725, 709

(56) References Cited

U.S. PATENT DOCUMENTS 4,638,405 A * 1/1987 Smith ..... 361/399

FOREIGN PATENT DOCUMENTS

DE 198 23 648 * 5/1998

* cited by examiner

*Primary Examiner*—Khiem Nguyen
(74) *Attorney, Agent, or Firm*—Eugene E. Renz, Jr., P.C.

(57) ABSTRACT

Connecting terminal for printed circuit boards comprising with an insulating housing (10), having a connection contact (18) attached to the housing (10) and an insertion opening (24) in the housing (10) through which a conductor can be inserted under the connection contact (18) with a clamping spring (26), which rests on the back of the connection contact (18) and has a free elastic sidepiece (32), where the elastic sidepiece (32) is bent over to form a clamping end (34), which grips under the connection contact (18) with its clamping edge and with an actuating element (40), which is supported pivotably in the housing (10) and acts on the elastic sidepiece (32) of the clamping spring (26), and which, in a clamping position, releases the elastic sidepiece (32) so that the clamping edge of the clamping end (34) pulls the conductor which has been inserted through the insertion opening (24) against the connection contact (18), and which, in an open position, presses the elastic sidepiece (32) down, so that, to allow the insertion of the conductor, the clamping edge is moved away from the connection contact (18), characterized in that the actuating element (40) has a lever (48) to pivot the actuating element (40) by a finger of the user between the open position and the clamping position.

8 Claims, 1 Drawing Sheet

CONNECTING TERMINAL ASSEMBLY

CROSS REFERENCE TO RELATED APPLICATIONS

This application is a continuation of U.S. patent application Ser. No. 09/151,010 filed Sep. 10, 1998, now U.S. patent application Ser. No. 6,270,384 and assigned to the assignee of the present application and invention.

FIELD OF THE INVENTION

The present invention relates to improvements in connecting terminals for printed circuit boards.

BACKGROUND OF THE INVENTION

A connecting terminal of the general type to which the present invention relates is known from, for example, DE 4,239,480 Al and DE 196-11,762 Al. In this known connecting terminal, an actuating element is pivotally mounted in a housing. In one of the positions into which it is pivoted, this element presses the free elastic sidepiece of a clamping spring down into its open position, whereas, in a second pivoted position, the element releases the sidepiece of the spring, so that it can clamp a conductor which has been inserted. A curved cam surface on the actuating element causes the elastic sidepiece of the clamping spring to move the required distance between the open position and the clamping position. Since the actuating element is pivoted by means of a suitable tool such as a screwdriver, it is necessary to have such a tool available. In many situations where the connecting terminal is installed, however, this type of actuation can be inconvenient.

SUMMARY OF THE INVENTION

According to the invention, the actuating element is designed with two arms and can pivot around a journal. One arm of the actuating element is used to pivot the actuating element around the journal. A cam, which rises in the radial direction with respect to the journal is provided on the second arm of the actuating element. The cam engages with the clamping spring. The actuating element is pivoted into a position in which it is essentially parallel to the direction in which the conductor is introduced, that is, essentially parallel to the plane of the printed circuit board so that a conductor introduced into the connecting terminal can be clamped. In this first position, the cam releases the clamping spring, so that this can clamp the conductor. When the actuating element is pivoted into a second position, perpendicular to the first position, the cam of the second arm presses the clamping spring down and holds it in an open position, so that a conductor can be introduced into the clamping spring.

The actuating element can be pivoted easily and without the use of a tool. For this purpose, a lever is provided on the first arm of the actuating element, whereby the user can press a finger down on this lever to pivot the actuating element. The lever projects out essentially at a right angles from the arm of the actuating element. As a result, when the element is in the open position, the lever projects freely out from the front surface of the housing of the connecting terminal. As soon as the conductor to be connected is introduced into the housing and into the clamping spring, the user presses the lever down with a finger, whereby the actuating element is pivoted into the clamping position. In this position, the actuating element releases the spring so that the clamping spring can clamp the conductor. In this clamping position, the lever of the actuating element rests against the front surface of the housing, so said lever does not interfere with anything and does not project out beyond the outside contour of the housing.

BRIEF DESCRIPTION OF THE DRAWINGS

These and other objects of the present invention and various features and details of the operation and construction thereof are hereinafter more fully set forth with reference to the accompanying drawings, wherein.

The invention is explained in greater detail on the basis of an exemplary embodiment, which is illustrated in the drawing.

DETAILED DESCRIPTION OF THE PREFERRED EMBODIMENT

Figure 2:
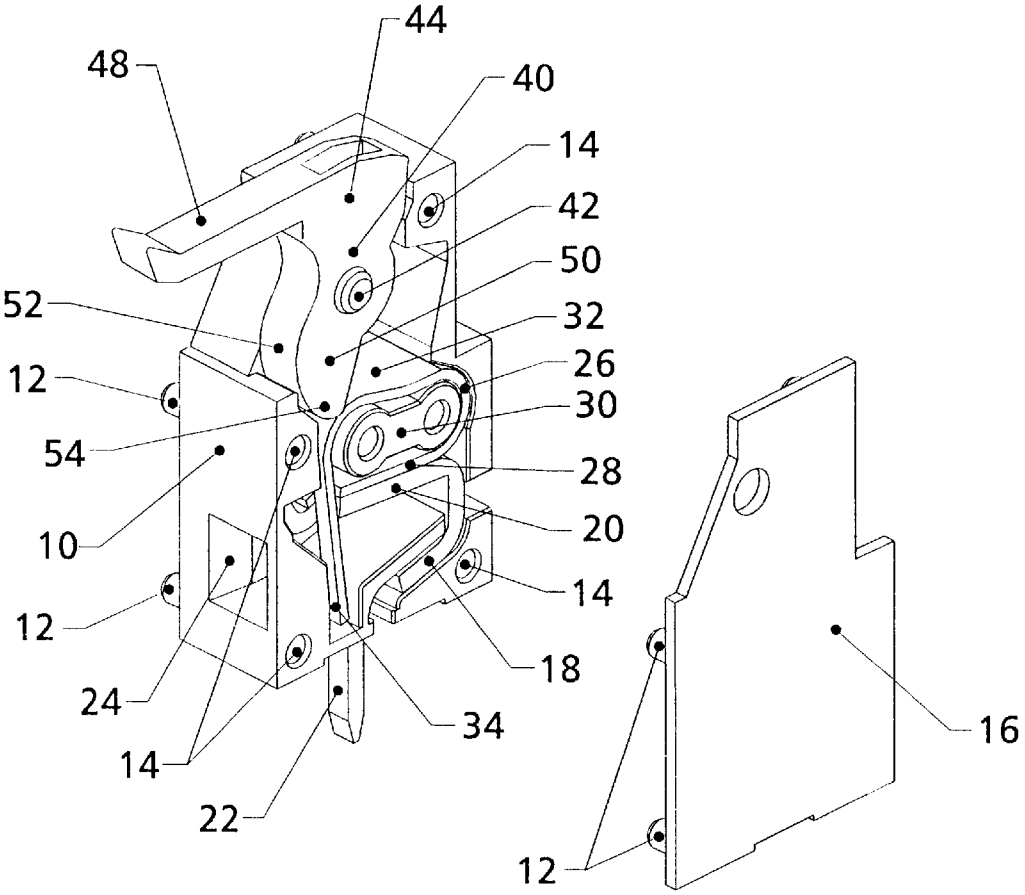
FIG. 2 shows a corresponding diagram of the connecting terminal in the open position.

As can be seen from the drawing, the connecting terminal consists of a single-pole clamping module. Individual clamping modules can be joined together in any desired number to form a multi-pole connecting terminal.

Each single-pole connecting terminal has a housing (10) made of plastic. Pins (12) are molded onto one side of housing (10) and corresponding holes (14) are provided on the opposite side. When the housing (10) is assembled to form a multi-pole connecting terminal, pins (12) of one housing module engage in the corresponding holes (14) of the adjacent housing module.

Each housing (10) has a frame, which is closed on one side by a side wall, so that a holding space is formed inside housing (10). During the assembly of a multi-pole connecting terminal, the open side of housing (10) is closed off by the corresponding closed side of adjacent housing (10). The open side of housing (10) which comes at the end of the row of a multi-pole connecting terminal is closed off by a side cover (16), which corresponds to the closed side wall of housing (10) and which is provided with corresponding pins (12).

In the holding space of housing (10), a connection contact (18) is inserted from the open side; this contact is a dimensionally stable sheet-metal part. Connection contact (18) is bent into the shape of a "U". One are of the sidepieces of the U forms a contact bridge (20), whereas the other sidepiece continues as a soldering pin (22). Soldering pin (22) passes out through the bottom of housing (10). The bottom of housing (10) is set down on a printed circuit board (not shown) so that soldering pin (22) can engage in a hole in the printed circuit board, to which it is then soldered. U-shaped connection contact (18) opens toward the front end of the frame of housing (10). An insertion opening (24), which is aligned with U-shaped connection contact (18), passes through this front end of the frame.

Above contact bridge (20) of connection contact (18) there is a clamping spring (26), one sidepiece (28) of which rests on the rear surface of contact bridge (20) at the top. Proceeding from this sidepiece (28), clamping spring (26) is bent upward and around a positioning projection (30). Positioning projection (30) is molded onto the side of housing (10) and projects into the holding space of housing (10). Above positioning projection (30), clamping spring (26) forms a free elastic sidepiece (32), which is itself bent down toward sidepiece (28), with the result that free sidepiece (32), the end of which forms a clamping end (34), is essentially perpendicular to both sidepiece (28) and contact bridge (20). An opening (36) is provided in clamping end (34). Contact bridge (20) of connection contact (18) and sidepiece (28) of clamping spring (26), which rests on the bridge, pass through this opening (36). Clamping spring (26) is made of an elastic, springy metal, which is pretensioned in such a way that sidepiece (32) is always trying to move away from sidepiece (28) and contact bridge (20). As a result, conductor introduces through the insertion opening (24) and the opening (36) under the contact bridge (20) is clamped against contact bridge (20) and is connected in an electrically conductive manner to soldering pin (22) via connection contact (18).

An actuating element (40), which is produced as a separate plastic part, is used to actuate the connecting terminal. When the connecting terminal is assembled, this element is placed in the holding space of housing (10).

The actuating element (40), which is made of plastic, has two arms (44*a* and 50*b*) and can pivot around a journal (42), formed on the inside surface of the side wall of the housing (10). The first arm (44) of the actuating element (40) extends from the journal (42) toward an opening (46) in the front and top of housing (10). A lever (48) is formed at the free end of the first arm (44), which projects essentially at a right angles from the first arm (44) and projects out from the housing (10) through the opening (46) in the housing (10). The user can press a finger down on the lever (48) to pivot the actuating element (40) around the journal (42), which serves as the center of rotation.

The second arm (50) of the actuating element (40), which faces away from the front of the housing (10) and points to the rear, has a cam (52) on its bottom surface, facing the clamping spring (26). This cam (52) is designed in such away that its radius (R), relative to the journal (42), increases continuously toward the free end of the second arm (50). The sidepiece (32) of the clamping spring (26) rests by is flexural center, which forms the transition between the spring sidepiece (32) and the clamping end (34), against the cam (52) of the second arm (50) under the action of the elastic force. The cam (52) extends to form a projection (54) at the free end of the second arm (50).

Figure 1:
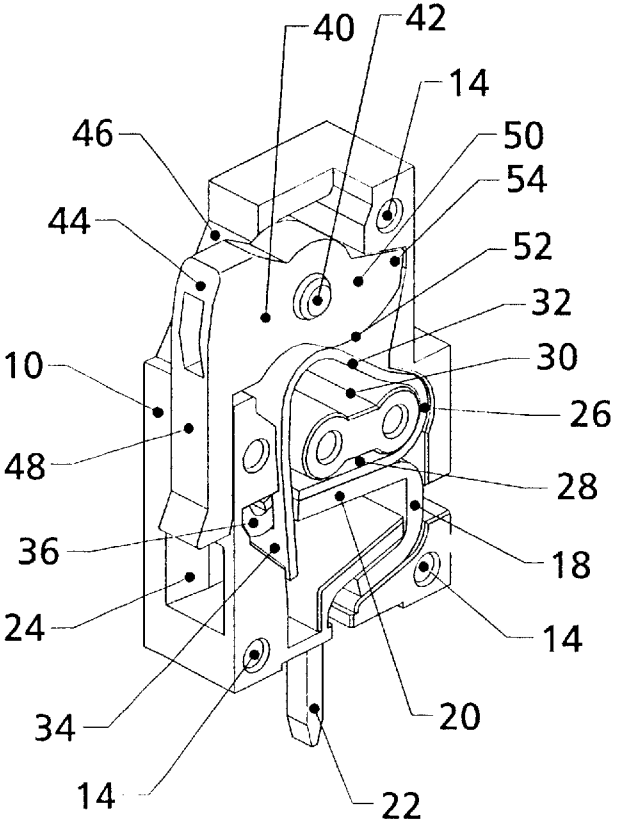
FIG. 1 shows a perspective view of the connecting terminal in the clamping position, with the side cover removed.

With the help of the lever (48), the actuating element (40) can be pivoted by approximately 90° between the clamping position shown in FIG. 1 and the open position shown in FIG. 2. In the clamping position, the actuating element (40) is essentially horizontal and parallel to the plane of the printed circuit board, whereas in the open position, the actuating element (40) is essentially perpendicular to the printed circuit board. In the clamping position shown in FIG. 1, the spring sidepiece (32) is resting against the part of the cam (52) with the smallest radius. Accordingly, the spring sidepiece (32) can move upward under its own elastic force until the lower clamping edge of the opening (36) of the clamping end (34) meets the contact bridge (20) of the connecting contact (18).

When the actuating element (40) is pivoted upward, the cam (52) slides along the spring sidepiece (32) and presses it increasingly downward. In the end position shown in FIG. 2, in which the spring sidepiece (32) has been pushed all the way down, the projection (54) of the second arm (50) has shifted forward over the flexural center of the spring sidepiece (32). In this position, the spring sidepiece (32), which is pressing upward with its elastic force against the second arm (50), presses the projection (54) forward as a result of the bending of its flexural center, so that the actuating element (40) is held in the open position shown in FIG. 2 in a self-locking manner. The connecting terminal can thus remain in the open position without any additional help until the conductor to be connected is inserted through the insertion opening (24) in the housing (10) and in the opening (36) of the clamping end (34) of the clamping spring (26) and rests against the underside of the contact bridge (20). To clamp the conductor thus introduced, the user uses a finger to press down on the lever (48), which is projecting freely forward, and thus to move it downward out of the position shown in FIG. 2 and into the position shown in FIG. 1. As this is happening, the projection (54) must first press the spring sidepiece (32) down slightly to escape from the self-locking latching position. As the actuating element (40) continues to pivot, the spring sidepiece (32) can follow the cam (52) and move upward under its elastic force into the clamping position shown in FIG. 1. In the end position shown in FIG. 1, in which the inserted conductor is clamped, the lever (48) rests flat against the end surface of the housing (10), so that it does not project in an interfering manner out beyond the peripheral contour of the housing (10).

Even though a particular embodiment of the invention has been illustrated and described herein, it is not intended to limit the invention and changes and modifications may be made therein within the scope of the following claims.

What is claimed is:

1. A connecting terminal assembly for printed circuit boards comprised of individual single pole clamping modules, each module comprising:

an insulating, molded plastic housing (10) formed with holding space;

said holding space containing a "U" shaped connection contact (18), a clamping spring (26), and an actuating element (40) wherein one side-piece of said connection contact forms a contact bridge (20) and another sidepiece forms a soldering pin (22) extending below said housing;

said clamping spring (26) resting on said contact bridge (20) and wherein said clamping spring (26) having a clamping end (34) and an opening (36) for insertion and holding a wire conductor;

said actuating element (40) being pivotable into an open position holding said clamping end (34) downwardly toward said soldering pin (22) so that to form an open position for inserting said wire conductor therein;

said actuating element (40) being pivotable into a clamping position releasing said clamping end (34) so that to clamp said wire conductor between said clamping end (34) and said contact bridge (20); and a lever (48) formed integrally with said actuating element to pivot said actuating element between open position and clamping positions, whereby said lever (48) projects out of the housing (10) at a right angle to the front of the housing (10) in the open position of the clamping spring (26) and is generally parallel to the front of the housing (10) and rests against the front of the housing (10) in the clamping position.

2. Connecting terminal according to claim 1, characterized in that the actuating element (40) and the lever (48) are made of a single piece of plastic.

3. Connecting terminal according to claim 1, characterized in that the actuating element (40) is designed with two arms, in that the lever (48) is formed on a first arm (44) of the actuating element (40), and in that the second arm (50) of the actuating element (40) acts on the spring sidepiece (32).

4. Connecting terminal according to claim 3, characterized in that the second arm (50) of the actuating element (40) has a cam (52) in contact with the spring sidepiece (32), which cam rises in the radial direction with respect to the center of rotation of the actuating element (40) toward the free end of the second arm (50).

5. Connecting terminal according to claim 1, characterized in that the lever (48) projects out of the housing (10) through an opening (46) provided in the housing (10).

6. Connecting terminal according to claim 5, characterized in that the opening (46) is provided on the front of the housing (10) and in that the lever (48) projects out of the housing (10) at the front.

7. Connecting terminal according to claim 3, characterized in that the lever (48) is essentially perpendicular to the first arm (44) of the actuating element (40).

8. Connecting terminal according to claim 7, characterized in that, in the open position, the actuating element (40) is essentially perpendicular to the printed circuit board and the lever (48) projects out of the housing (10) at a right angle to the front of the housing (10); and in that, in the clamping position, the actuating element (40) is essentially parallel to the printed circuit board, and the lever (48) rests against the front of the housing (10).

* * * * *